US006578342B2

(12) United States Patent
Faynor

(10) Patent No.: US 6,578,342 B2
(45) Date of Patent: Jun. 17, 2003

(54) BARRIER CABLE END BRACKET ASSEMBLY

(76) Inventor: Paul Milan Faynor, 34011 Blue Lantern, Dana Point, CA (US) 92629

( * ) Notice: Subject to any disclaimer, the term of this patent is extended or adjusted under 35 U.S.C. 154(b) by 0 days.

(21) Appl. No.: 09/886,539

(22) Filed: Jun. 19, 2001

(65) Prior Publication Data

US 2002/0189193 A1 Dec. 19, 2002

(51) Int. Cl.[7] ..... E04B 1/38
(52) U.S. Cl. ..... 52/713; 256/32; 256/4
(58) Field of Search ..... 52/698, 713, 223.14, 52/127.2; 248/56, 47, 72; 182/86; 256/32, 33, 47, 19, 2

(56) References Cited

U.S. PATENT DOCUMENTS

| | | | | |
|---|---|---|---|---|
| 1,710,842 A | | 4/1929 | Salustri | |
| 3,201,834 A | | 8/1965 | Baittinger | |
| 3,757,528 A | | 9/1973 | Finsterwalder et al. | |
| 3,989,226 A | | 11/1976 | Burgess | |
| 4,848,954 A | | 7/1989 | Wiseman | |
| 4,858,383 A | | 8/1989 | Kendig | |
| 4,926,592 A | | 5/1990 | Nehls | |
| 6,324,810 B1 | * | 12/2001 | Thompson | 52/713 |
| 6,327,825 B1 | * | 12/2001 | Sanders et al. | 52/223.14 |

FOREIGN PATENT DOCUMENTS

| | | | |
|---|---|---|---|
| SU | 1094928 A | * | 5/1984 |

* cited by examiner

*Primary Examiner*—Carl D. Friedman
*Assistant Examiner*—Nahid Amiri
(74) *Attorney, Agent, or Firm*—Eric Karich

(57) ABSTRACT

A barrier cable end bracket assembly for attaching a plurality of barrier cables to a concrete support column has a cable mounting bracket for supporting the plurality of barrier cables, and an opposing rear mounting plate for locking the cable mounting bracket onto the concrete support column. The assembly further includes a sleeve for positioning through the concrete support column, an anchor rod having a proximal end and a distal end, a first nut for anchoring the proximal end to the cable mounting sidewall, and a second nut for anchoring the distal end to the rear mounting plate.

3 Claims, 3 Drawing Sheets

BARRIER CABLE END BRACKET ASSEMBLY

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to a barrier cable end bracket assembly, and more particularly to a barrier cable end bracket assembly that is anchored to a concrete support column with an anchor rod that positioned within a sleeve through the concrete support column.

2. Description of Related Art

The following art defines the present state of this field:

Kendig, U.S. Pat. No. 4,858,383, teaches a security enclosure including an access gate comprising at least one rigid barrier which can be retracted or advanced by remotely-actuated power means for opening and closing the gate. The barrier includes chains interconnected with metallic connectors positioned through massive concrete blocks.

Wiseman, U.S. Pat. No. 4,848,954, teaches a method provided for forming a rigid joint between two tubular frame members positioned end to end but not necessarily in abutment, each said member having a tubular wall defined by an outer surface and an inner surface defining an interior passageway, each member being congruent with the other said member in the region of the ends to be joined, each said member having a substantially square cross section with at least one pair of diagonally opposing comers. The method comprises the step of securing one of said members to the other by passing at least a pair of elongated fastening means, one through each member, diagonally through the wall of each member at diagonally opposing corners of said member adjacent the ends to be joined. Said pair of fastening means also passes through and engages a rigid coupling disposed about the outside surface of said tubular wall in the region of said opposing corners and extends on either side of the joint for rigidly holding said members to each other in proper end to end alignment.

Other devices, similar to Wiseman, include D. Salustri, U.S. Pat. No. 1,710,842, which teaches a device for joining end to end wooden post sections, and J. R. Baittinger, U.S. Pat. No. 3,201,834, which teaches a method of connecting timber piles in end to end upright positions.

Finsterwalder et al., U.S. Pat. No. 3,757,528, teaches a method for producing a bearing pile of steel reinforced concrete in a bore hole where armoring is placed in the bore hole which is filled with hardening material such as concrete and where the armoring is a steel pressure element of compact, particularly round cross-section provided with profiling on its surface to increase the adhesion between the filling material and where after setting, but prior to hardening the filling material is impregnated with cement sludge or grouting through and apertured conduit that is disposed between the steel pressure member and the wall of the bore hole.

Nehls, U.S. Pat. No. 4,926,592, teaches a breakaway coupling to be interposed between a ground mounting post and a support post carrying a highway sign, barricade or similar highway appurtenance. The coupling has a horizontal plate on a pedestal which attaches to the mounting post and a horizontal plate on a support post mounting member which attaches to the support post. Bolts normally holding the plates together release upon vehicular impact. Use of a novel plate configuration, a gasket and roller cams enhance the structure.

Burgess, U.S. Pat. No. 3,989,226, teaches a bracket assembly comprising a pair of opposed channel plates supporting a fence board clamped therebetween, and having a bearing sleeve portion extending from one of said plates through a bore in the fence post in which said brackets are mounted, the other of said pair of plates having a bolt extending therefrom through said sleeve, and a nut on the end of the bolt for suitably tightening a washer on said bolt against said post and the outer end of said sleeve.

The prior art teaches positioning a rod through a concrete pillar for anchoring a fence structure. However, the prior art does not teach an assembly that includes a sleeve that is positioned through the concrete pillar during its construction so that an anchor rod can be positioned through the concrete pillar during later construction of the fence structure. The present invention fulfills these needs and provides further related advantages as described in the following summary.

SUMMARY OF THE INVENTION

The present invention teaches certain benefits in construction and use which give rise to the objectives described below.

The present invention provides a barrier cable end bracket assembly for attaching a plurality of barrier cables to a concrete support column. The assembly includes a cable mounting bracket for supporting the plurality of barrier cables and an opposing rear mounting plate for locking the cable mounting bracket onto the concrete support column. The assembly further includes a sleeve for positioning through the concrete support column, an anchor rod having a proximal end and a distal end, a first anchor means for anchoring the proximal end to the cable mounting sidewall, and a second anchor means for anchoring the distal end to the rear mounting plate.

A primary objective of the present invention is to provide a barrier cable end bracket assembly having advantages not taught by the prior art.

Another objective is to provide a barrier cable end bracket assembly that includes a sleeve that can be positioned within a column form used for constructing the concrete support column such that when the concrete support column is formed, the sleeve is operably positioned within the concrete support column so that an anchor rod can be positioned through the concrete support column.

A further objective is to provide an assembly that functions to anchor a plurality of barrier cables to a concrete support column with enough strength to prevent the plurality of barrier cables from being ripped away from the concrete support column in the event of an object, such as an automobile, crashing into the plurality of barrier cables.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
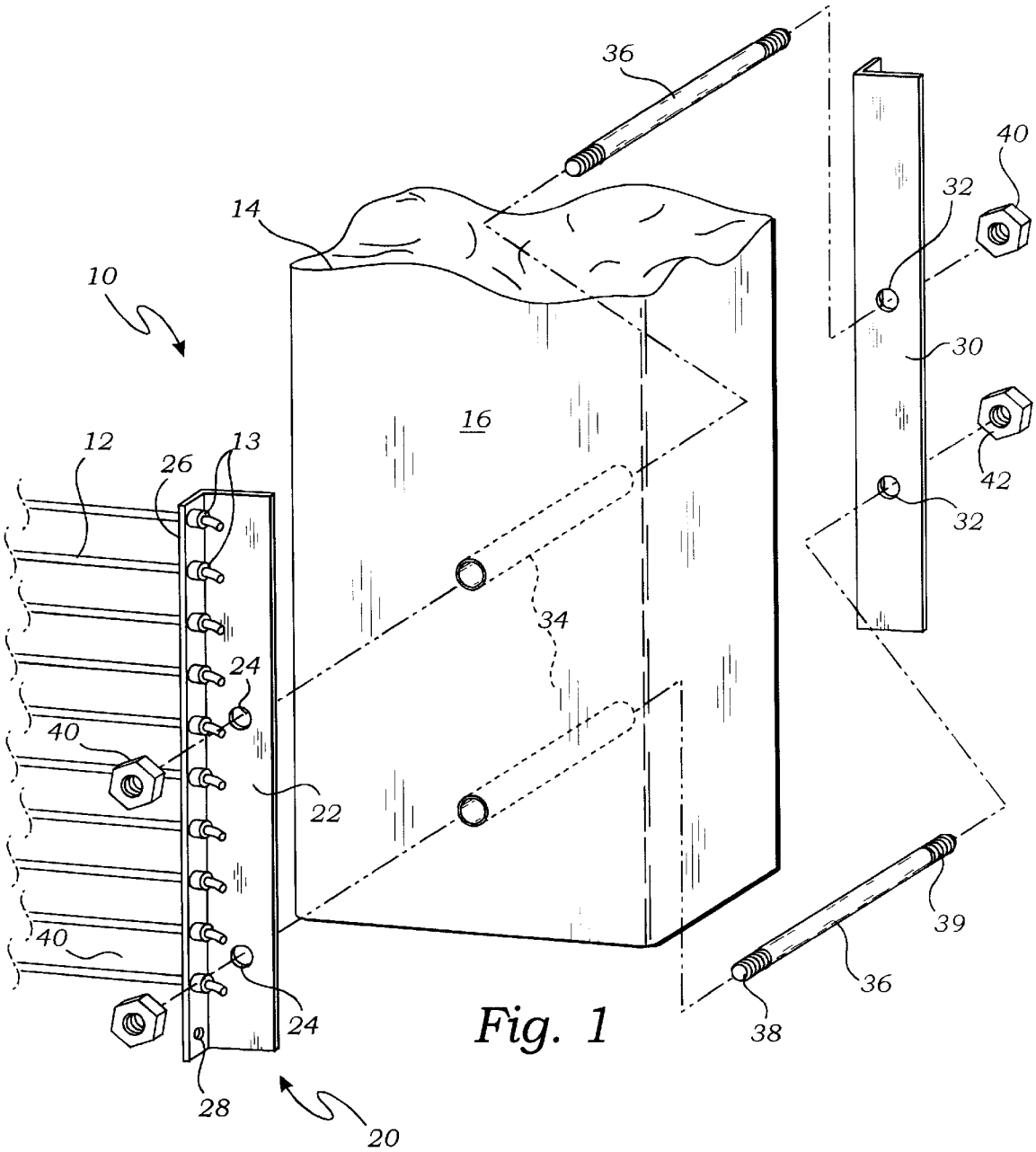
FIG. 1 is a perspective exploded view of the preferred embodiment of the present invention.

The above described drawing figures illustrate the invention, a barrier cable end bracket assembly 10 for attaching a plurality of barrier cables 12 to a concrete support column 14. The assembly 10 includes a cable mounting bracket 20 for supporting the plurality of barrier cables 12 and an opposing rear mounting plate 30 for locking the cable mounting bracket 20 onto the concrete support column 14. The assembly 10 further includes a sleeve 34 that is positioned through the concrete support column 14 to receive an anchor rod 36 having a proximal end 38 and a distal end 39. The assembly 10 further includes a first anchor means for anchoring the proximal end 38 to the cable mounting sidewall 26, and a second anchor means for anchoring the distal end 39 to the rear mounting plate 30. In the preferred embodiment, the assembly 10 includes at least two of the anchor rods 36 and associated components; however, for clarity, the description discusses the inclusion of only one anchor rod 36.

Figure 3:
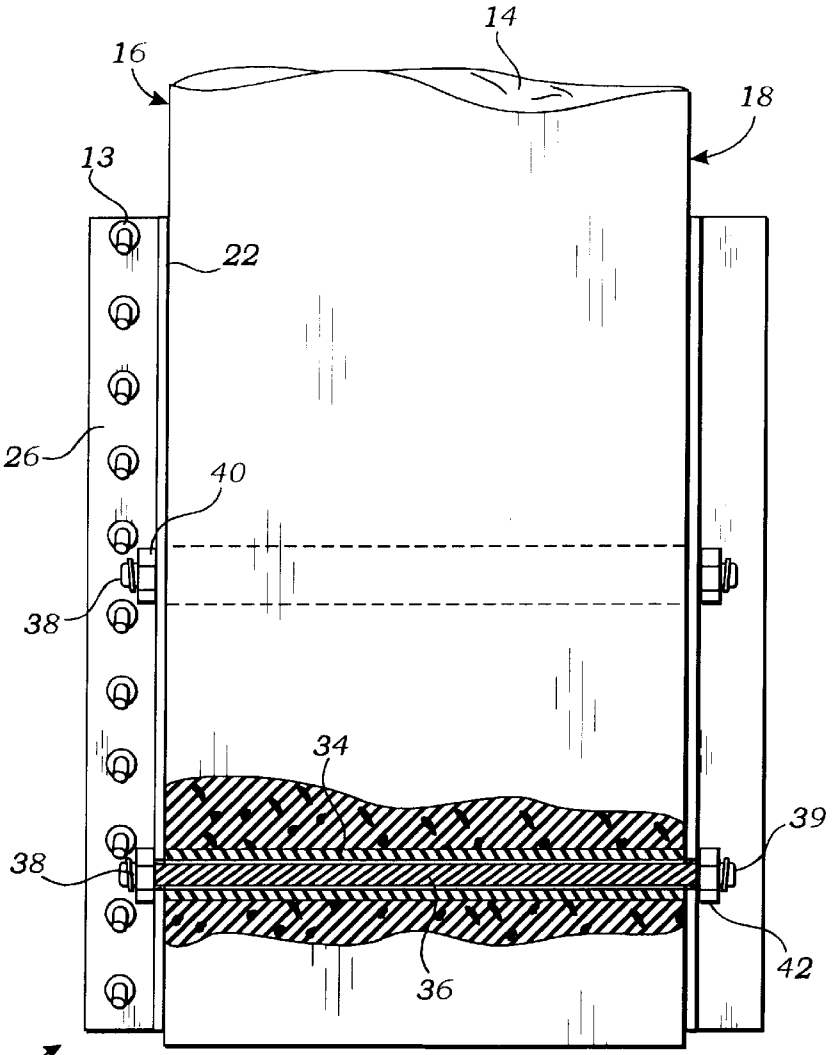
FIG. 3 is a side elevational view thereof.
Figure 2:
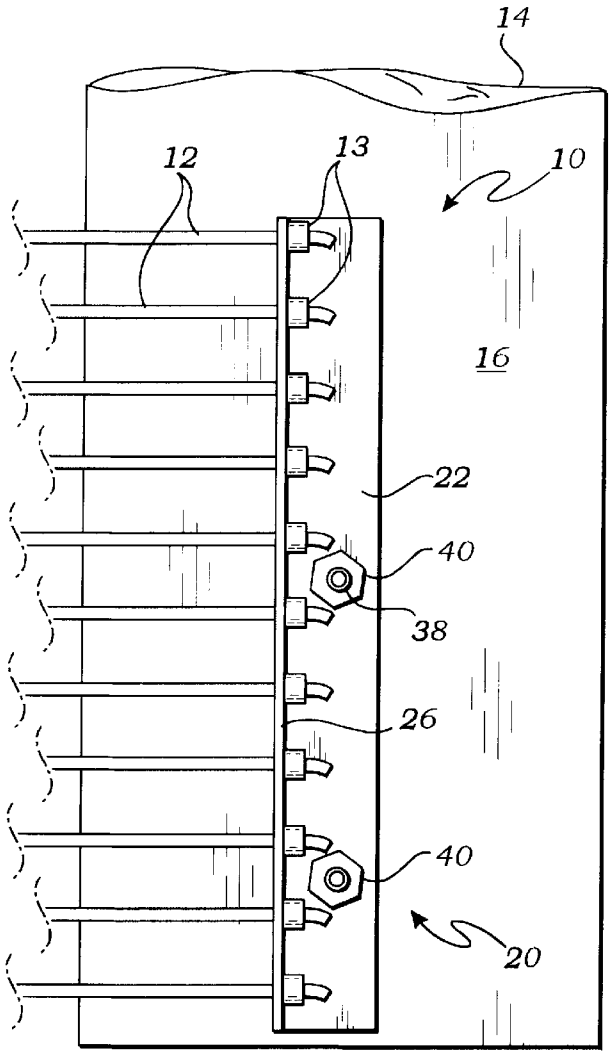
FIG. 2 is a front elevational view thereof.

As shown in FIGS. 1-3, the cable mounting bracket 20 includes a column mounting sidewall and a cable mounting sidewall 26. The column mounting sidewall 22 is adapted to abut the front side 16 of the concrete support column 14 such that the assembly 10 can be anchored to the concrete support column 14, as described below. The cable mounting sidewall 26 includes a plurality of cable apertures 28 that are vertically spaced according to specifications required by ICBO building codes. The cable mounting sidewall 26 is designed so that each of the plurality of barrier cables 12 can be positioned through one of the plurality of cable apertures 28 and tightly locked with a post tension donut 13 according to techniques well known in the art. The cable mounting sidewall 26 is preferably integral with and extends perpendicular to the column mounting sidewall 22, although alternative configurations can be devised by those skilled in the art. The cable mounting bracket 20 is constructed of a strong, durable material such as steel.

As shown in FIGS. 1 and 3, the rear mounting plate 30 is adapted to be positioned adjacent a rear side 18 of the concrete support column 14, opposite the cable mounting bracket 20, and serve as an anchor to keep the anchor rod 36 and the cable mounting bracket 20 from being torn off of the front side 16 of the concrete support column 14. The rear mounting plate 30 preferably includes a distal aperture 32 that receives the anchor rod 36, as described below. The rear mounting plate 30 is preferably a elongate, rectangular steel sheet, plate, or bracket; however, the rear mounting plate 30 can be a simple washer, or even a part of the second anchoring means, as described below.

Figure 4:
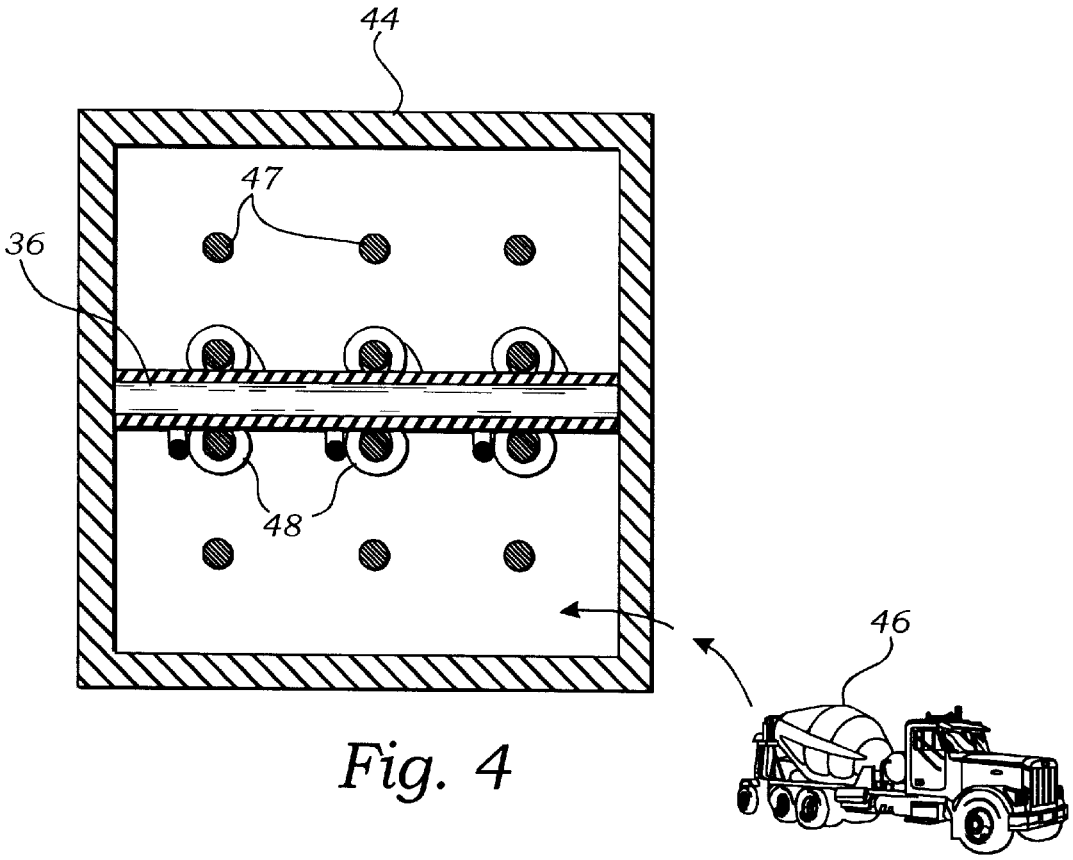
FIG. 4 is a top plan sectional view of a sleeve positioned within a column form.

As shown in FIGS. 1, 3, and 4, the sleeve 34 is shaped to be positioned through the concrete support column 14 to enable the anchor rod 36 to be inserted through the concrete support column 14. The sleeve 34 is preferably a steel cylinder having a length that is equal to the width (or diameter) of the concrete support column 14, and having a diameter large enough to accept the anchor rod 36.

As shown in FIGS. 1-4, the anchor rod 36 has a proximal end 38 and a distal end 39 and is shaped to fit through the sleeve 34. The anchor rod 36 must be strong enough to withstand substantial strain, and is preferably a 1⅛ inch diameter Grade B-7 steel rod, assuming that two of the anchor rods 36 are used, as described above. It is possible to include additional or fewer anchor rods 36, as long as the strength of the combined components is enough to provide the connection strength desired and required by ICBO building codes.

In the preferred embodiment, the proximal end 38 and the distal end 39 are both threaded for cooperation with the first and second anchor means. In this embodiment, the first anchor means is a first nut 40 that is adapted to threadedly engage the proximal end 38 of the anchor 20 rod 36; and the second anchor means is a second nut 42 that is adapted to threadedly engage the distal end 39 of the anchor rod 36. Those skilled in the art can obviously develop many alternative embodiments to this arrangement. For example, the anchor rod 36 could include an integral head (not shown), similar to a bolt, that would function to replace one of the first or second nuts 40 and 42. Another example includes a locking mechanism, such as a locking pin (not shown) through the anchor rod 36 that would also serve to replace one of the first or second nuts 40 or 42. Another example includes threadedly engaging the anchor rod 36 directly into the cable mounting bracket 20 and/or the rear mounting plate 30. A specific example of this includes providing the rear mounting plate 30 in the form of the second nut 42 into which the distal end 39 can be engaged, threadedly or otherwise; however, in this embodiment, the second nut 42 would preferably include a flange (not shown) to help prevent the anchor rod 36 from being pulled through the concrete support column 14. The purpose of the structure is simply to lock the cable mounting bracket 20 onto the concrete support column 14 using the rear mounting plate 30, so any equivalent locking mechanism should be considered within the scope of the claimed invention.

The invention includes a method for attaching the plurality of barrier cables 12 to the concrete support column 14 using the barrier cable end bracket assembly 10 described above, including the cable mounting bracket 20, the rear mounting plate 30, the sleeve 34, and the anchor rod 36. The method starts during construction of the parking structure in which the barrier cables 12 are being installed. As shown in FIG. 4, a column form 44 is provided for constructing the concrete support column 14. The sleeve 34 is positioned within the column form 44 such that the sleeve 34 will traverse the concrete support column 14 once the concrete support column 14 has been formed. The sleeve 34 is preferably tied, with a fastener 48 such as wire or cord, to rebar 47 that is being used in the construction of the concrete support column 14. This method is particularly useful when the column form 44 being used is made of metal. If the column form 44 is made of wood, holes can be drilled through the column form 44 to facilitate anchoring the sleeve 34; however, this is not preferred. Once the sleeve 34 has been properly positioned, concrete 46 is poured into the column form 44, thereby forming the concrete support column 14 with the sleeve 34 traversing the concrete support column 14 from a front side 16 to a rear side 18 of the concrete support column 14. Finally, the column form 44 is removed once the concrete 46 is hard and dry. The construction of the concrete support column 14 is well known in the art, and is therefore not described in greater detail.

As shown in FIG. 1, the cable mounting bracket 20 is then positioned such that the column mounting sidewall 22 abuts the front side 16 of the concrete support column 14 over the sleeve 34. A proximal aperture 24 is then formed through the column mounting sidewall 22 adjacent the sleeve 34. The proximal aperture 24 is preferably formed by marking the position of the sleeve 34 and then drilling the proximal aperture 24 to match the location of the sleeve 34. It is equivalent to provide the column mounting sidewall 22 with a pre-formed proximal aperture 24 if only a single sleeve 34 is used; however, in the preferred embodiment, in which two sleeves 34 are used, it is necessary to drill at least one of the proximal apertures 24 because it is not likely that the sleeves 34 can be positioned within the column form 44 with enough accuracy to match the pre-drilled proximal apertures 24. Drilling at least one of the proximal apertures 24 to match the locations of the sleeves 34 is the preferred method.

Once the anchor rod 36 has been positioned through the sleeve 34 such that the proximal end 38 extends into, and preferably through, the proximal aperture 24 of the column mounting sidewall 22, the proximal end 38 is anchored to the column mounting sidewall 22 using the first anchor means, preferably threadedly engaging the first nut 40 with the proximal end 38. This process is repeated using the rear mounting plate 30. The rear mounting plate 30 is positioned adjacent the rear side 18 of the concrete support column 14 and the distal end 39 is anchored to the rear mounting plate 30, preferably by threadedly engaging the second nut 42 to the distal end 39 of the anchor rod 36. An equivalent method would, of course, include anchoring the rear mounting plate 30 to the distal end 39 and then positioning the rear mounting plate 30 adjacent the rear side 18. As described above, the first nut 40 and the second nut 42 can be replaced by equivalent structures. For example, the rear mounting plate 30 might include a distal aperture 32 that is internally threaded, and the distal end 39 could threadedly engage the distal aperture 32. If the rear mounting plate 30 is an elongate, tiff rectangular steel plate, and is anchored to more than one of the anchor rod 36, the distal aperture 32 might be drilled in the manner described above to assure that each distal aperture 32 matches up with each sleeve 34.

Those skilled in the art will recognize that the order of many of these steps can be altered without altering the invention. For example, the anchor rod 36 might be anchored first to the rear mounting plate 30 and then inserted into the sleeve 34 and anchored to the column mounting sidewall 22. Obvious modifications such as this, which have no bearing on the overall purpose of the method, should be considered within the scope of the claimed invention.

In addition to the anchor rod 36 or rods that are described in the present invention, the assembly 10 preferably further includes five 5/8 inch wedge anchors (not shown) that are attached to the concrete support column 14 through the column mounting sidewall 22. The specific number of additional anchors included, and the type of anchors used, is not important to the present invention, so these anchors are not described in any additional detail herein. Those skilled in the art can devise many additional features of the assembly 10, such as a cover plate (not shown), and other features, and these additional elements should be considered within the scope of the present invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A barrier cable end bracket assembly adapted to be anchored in a concrete support column, the assembly comprising:

a cable mounting bracket having a column mounting sidewall and a cable mounting sidewall, the cable mounting sidewall having a plurality of cable apertures;

a plurality of barrier cables, each of the plurality of barrier cables being adapted to be attached to one of the plurality of cable apertures;

a rear mounting plate having a distal aperture;

a sleeve shaped to be positioned through the support column;

an anchor rod having a proximal end and a distal end, the anchor rod being shaped to fit through the sleeve;

a first anchor means for anchoring the proximal end to the cable mounting sidewall; and a second anchor means for anchoring the distal end to the rear mounting plate.

2. The assembly of claim 1 wherein the first anchor means is a first nut adapted to threadedly engage the proximal end of the anchor rod; and wherein the second anchor means is a second nut adapted to threadedly engage the distal end of the anchor rod

3. The assembly of claim 1 wherein the rear mounting plate is an elongate rectangular plate.

* * * * *